United States Patent [19]

Fletcher

[11] Patent Number: 4,630,610

[45] Date of Patent: Dec. 23, 1986

[54] SURGICAL VEST

[76] Inventor: Jo Ann Fletcher, 220 Carroll Dr., St. Clairsville, Ohio 43950

[21] Appl. No.: 759,251

[22] Filed: Jul. 26, 1985

[51] Int. Cl.[4] ..... A41C 3/00

[52] U.S. Cl. ..... 128/501; 2/51; 2/DIG. 7; 128/503

[58] Field of Search ..... 2/DIG. 7, 51; 128/501, 128/503, 504

[56] References Cited

U.S. PATENT DOCUMENTS

| | | | |
|---|---|---|---|
| 1,242,118 | 10/1917 | Anderman | 128/501 X |
| 1,362,027 | 12/1920 | Miller | 128/503 |
| 1,537,681 | 5/1925 | Kops | 128/503 |
| 3,464,063 | 9/1969 | Hoegerman | 2/DIG. 7 |
| 3,628,539 | 12/1971 | Fredricks | 128/504 X |
| 4,414,691 | 11/1983 | Estruch | 2/DIG. 7 |

*Primary Examiner*—Louis K. Rimrodt

*Attorney, Agent, or Firm*—Webb, Burden, Robinson & Webb

[57] ABSTRACT

A surgical vest designed for use after mastectomy or mammoplasty and also for casual- and sleep-wear, which promotes postoperative healing and provides support for the breasts or prostheses by covering at least the thorax of a wearer with a soft thoracic sheath. The thoracic sheath bears one or two support straps on its outer surface; one end of the strap is attached in the area of the sternum of the wearer, and the other end of the strap is affixed in the area beneath the arm. As a result, the support straps pass beneath and support the breasts or prostheses without contacting or binding the underlying skin in any way. In addition, the thoracic sheath provides an absorbent dressing for the postoperative site and can serve to hold additional absorbent materials in place, either between its layers or adjacent the skin, eliminating the need for painful adhesive dressings in the area of the wound.

10 Claims, 5 Drawing Figures

SURGICAL VEST

FIELD OF THE INVENTION

The invention relates to feminine apparel, generally, and specifically relates to surgical vests suitable for wearing after mastectomy or mammoplasty.

INTRODUCTION

Substance reflects title. Throughout the historic U.S. medical and patent literature, support garments for the female anatomy have traditionally been characterized as "compression bandages," reflecting the philosophy which led to the initial designs. True to the unfortunate title, modern brassierres and corset-like garments continue to compress the wearer to a degree unwarranted by the legitimate breast-support function for which such garments are worn.

For healthy wearers, these tight garments create discomfort, impair circulation, and frequently actually damage underlying tissue and skin. For postoperative mastectomy or mammoplasty patients, who must wear support garments after surgery, these garments are excruciating and invariably retard or prevent healing of the postoperative site. A need remains, therefore, for a breast- or prosthesis-supporting garment which not only is comfortable to both pre- and postoperative wearers but which actually promotes healing and wellness in the area it covers.

BRIEF DESCRIPTION OF THE INVENTION

The present surgical vest is designed for use after mastectomy or mammoplasty and also for casual- or sleep-wear; the vest provides support for the breasts or prostheses by covering at least the throax of a wearer with a soft thoracic sheath. The thoracic sheath bears one or two support straps on its outer surface: one end of the strap is attached in the area of the sternum of the wearer, and the other end of the strap is affixed in the area beneath the arm. As a result, the support straps pass beneath and support the breasts or prostheses without contacting or binding the underlying skin in any way. In addition, the thoracic sheath provides an absorbent dressing for the postoperative site and can hold additional absorbent materials in place either between its layers or adjacent the skin, eliminating the need for painful adhesive dressings in the area of the wound.

DETAILED DESCRIPTION OF THE INVENTION

The surgical vest of the present invention is both a surgical dressing and a comfortable garment. The vest is suitable for wearing after mastectomy or mammoplasty (breast augmentation, reduction and prosthetic implantation) and embodies a skin covering which is absorbent and suitable for direct contact with a healing postoperative site. The vest is likewise suitable as an auxiliary dressing for holding additional absorbent materials in position without the application of adhesives to the skin. The vest may be constructed of washable or disposable materials for use as a dressing or may be constructed of any desired fabric for later postoperative or sleep- or leisure-wear.

The surgical vest functions as a support garment by sheathing the thorax (the general dorsal area between the neck and the waist of the wearer) with a snug yet comfortable sheath 20. As shown in the figures and discussed in detail below, the thoracic sheath 20 may include a number of features, but essentially the thoracic sheath 20 covers the thoracic area with soft fabric and preferably covers the thorax and the back (ventral area) of the wearer with a generally tubular and extensile covering. The thoracic sheath 20 may have either a high or a scoop neck.

Attached externally to the thoracic sheath 20 are at least one and normally two support straps 100, 110. As discussed in detail below, these straps are positioned beneath one or both breasts or prostheses of the wearer in order to support the breast or prosthesis from underneath. The effect of the support strap is to draw in and anchor the thoracic sheath 20 beneath the breast, creating the support effect of a loose brassierre cup, without contacting the thorax with irritating straps, seams, hems or bindings which might compress the body or irritate the postoperative site. Generally, the support strap may be sewn at its ends directly to the thoracic sheath 20 or may be anchored into reinforced areas of the sheath at its front and sides.

The support strap of the present invention differs from the support straps of other feminine support garments not only because the strap is external to the thoracic sheath but because the strap is free from the sheath except for its attached ends. Accordingly, the support strap is entirely self-adjusting, and may slide into the correct position beneath the breast or prosthesis depending upon the particular anatomy of any given wearer. The self-adjusting nature of the support strap contributes to the comfort of the surgical vest and also contributes to the promotion of healing of the operative site by its adjustable positioning, which prevents the unwanted compression which a stationary strap might create. The self-adjusting strap can accommodate all breast sizes and shapes, including surface prostheses and prosthetic implants.

Figure 1:
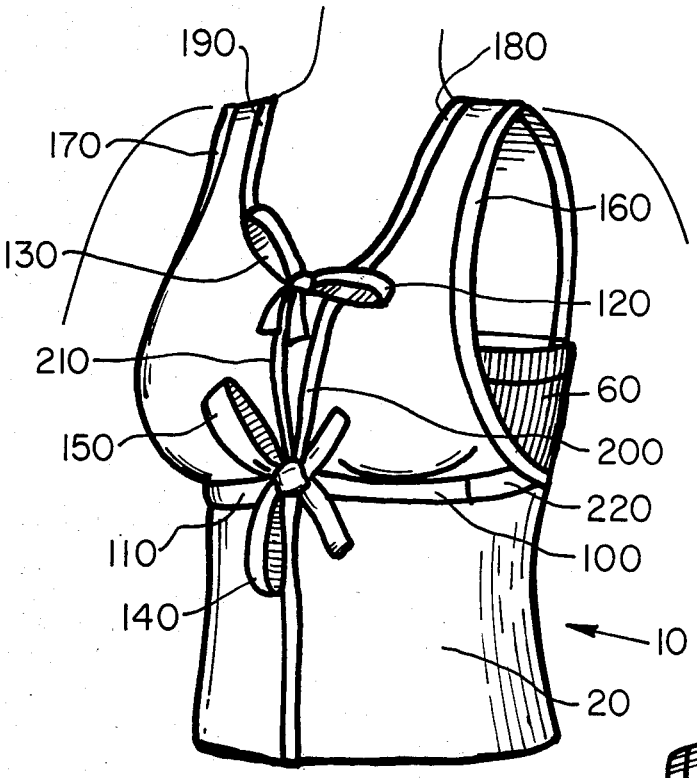
FIG. 1 is a plan view of the preferred embodiment of the surgical vest in position on a female patient.

The preferred embodiment of the surgical vest is illustrated in FIGS. 1–5. Referring now to FIG. 1, the surgical vest 10 includes the thoracic sheath 20 bounded by the left and right axillary bands 160, 170, the left and right axillary gussets 60, 70, the left and right neck bands 180, 190 and the left and right midline bands 200, 210. Moreover, in large part, the surgical vest 10 includes two layers of fabric. The underlying layer of fabric is generally tubular in structure and its visible areas, due to the armhole in the outer layer of the surgical vest 10, constitute the left and right axillary gussets 60, 70. This double layer of fabric creates large pockets, which are discussed in further detail below.

Figure 3:
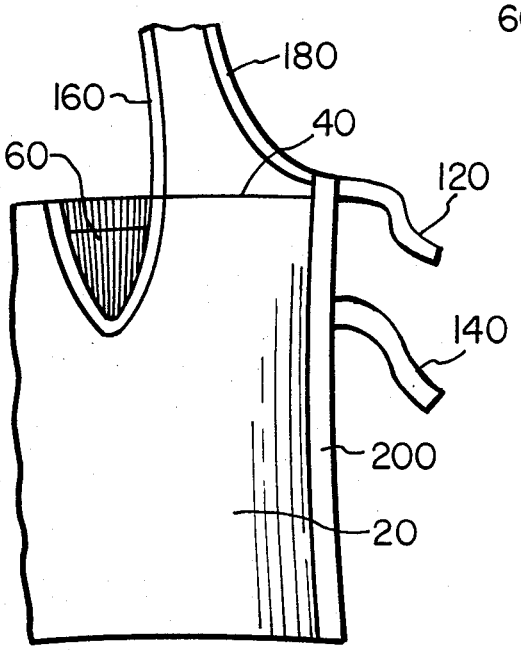
FIG. 3 is an elevational view of the inside left front of the surgical vest.
Figure 4:
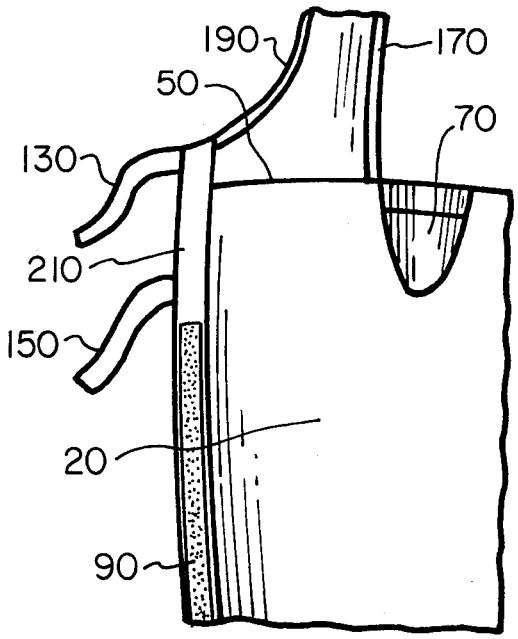
FIG. 4 is an elevational view of the inside right front of the surgical vest; and FIG..5 is a rear elevational view of the surgical vest of the present application.

Referring now to FIGS. 3 and 4, the left and right inside surfaces of the thoracic sheath 20 are shown, respectively. The left and right midline bands support the first, second, third and fourth closing means 120, 130, 140 and 150, which means are tapes suitable for tying in a bow to fasten the surgical vest 10 about the wearer. FIGS. 3 and 4 illustrate the double-layer construction of the surgical vest 10: except for the left and right axillary gussets 60, 70, the vest is double in thickness from the tops of the left and right thoracic pockets 40, 50 down to the lowermost edge of the thoracic sheath 20.

Figure 2:
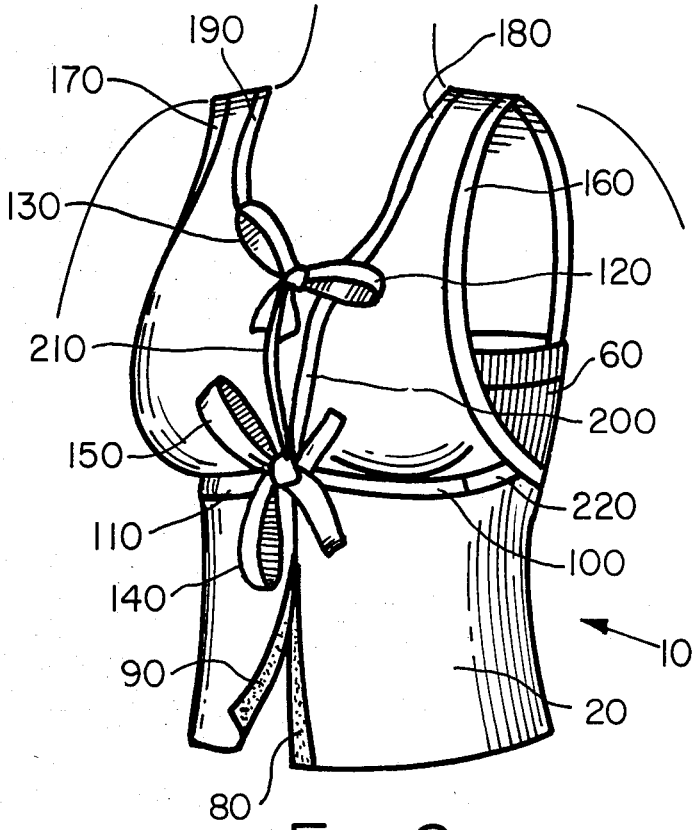
FIG. 2 is a plan view of the surgical vest illustrating the front-opening design of the preferred embodiment.

Referring now to FIG. 2, the left and right midline bands 200 and 210 are shown in releasable partial closure below the first, second, third and fourth closing means 120, 130, 140, 150. This releasable closure is effected by the first and second fastening means 80, 90; the second fastening means 90 is also shown in FIG. 4. The first and second fastening means 80, 90 may be any strip fastening means known in the art, including the hook and loop type fasteners sold by the trademark VELCRO ®. As a result of the first, second, third and fourth closing means 120, 130, 140 and 150 and the first and second fastening means 80, 90, the surgical vest 10 may be completely separated at the dorsal midline of the wearer for convenience in dressing and in therapeutic treatment.

Figure 5:
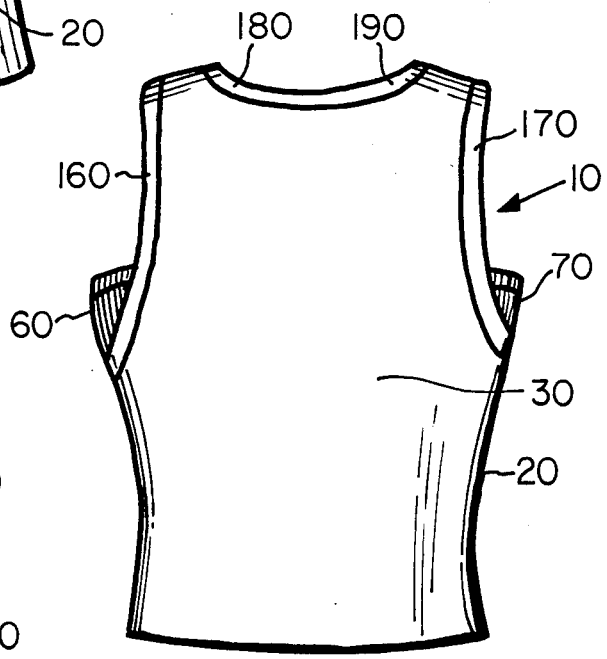

Referring now to FIG. 5, the surgical vest 10 is shown with a ventral sheath 30 which is continuous with the thoracic sheath 20. Preferably, the juncture between the ventral sheath 30 and the thoracic sheath 20 is seamless.

Referring once again to FIG. 1, the first and second support straps 100 and 110 are shown anchored to the left and right midline bands, 200, 210, and the left and right axillary bands 160, 170, respectively. The first and second support straps 100, 110 are attached to the left and right midline bands 200, 210 generally in the area of the sternum of the wearer and the opposite ends of each of the first and second support straps 100, 110 are attached to the respective left and right axillary bands 160, 170 at a point generally horizontal to the attachment of the respective strap on the midline band. Each of the first and second support straps 100, 110, remain unattached to the thoracic sheath 20 except at its respective attachment points. A first support strap elastic tab 220 appends a nonelastic tape to yield the support strap 100; the first support strap elastic tab imparts adjustability and gentle elasticity to the entire first support strap 100. (An equivalent elastic tab appends the second support strap 110, not shown.)

In operation, the surgical vest 10 provides a surgical dressing, a garment and a support for the breasts or prostheses as follows. The surgical vest 10 is wrapped around the torso of a patient or wearer with the first, second, third and fourth closing means in front. The closing means 120, 130, 140 and 150 are tied together, and the thoracic sheath 20 of the surgical vest 10 is further secured by pressing together the first and second fastening means 80, 90. The first and second support straps 100, 110 are self-adjusting until they are positioned immediately beneath the breasts or breast prostheses, enabling the support straps 100, 110 to support each breast or prosthesis in the manner of a gentle sling. As described above, furthermore, the support straps 100, 110 draw in the thoracic sheath 20, in the area of the breasts, to form the general shape of a brassiere cup without contacting the skin with anything except the thoracic sheath 20 itself. Additional adjustment of the first and second support straps 100, 110 may be accomplished by raising the left and right axillary gussets to a higher or lower position under the arm.

A number of variations on the preferred embodiment of the invention are possible without changing the character or the function of the surgical vest 10. The left and right axillary bands 160, 170, the left and right axillary gussets, 60, 70 the left and right midline bands 200, 210 and the left and right neck bands 180, 190 may be eliminated altogether. Indeed, the axillary gussets 60, 70 may be altogether unnecessary depending on the sizing of the garment and the fabrics used. Likewise, the first, second, third and fourth closing means 120, 130, 140 and 150 may be eliminated and other closure devices may be substituted, including lengthening the first and second fastening means 80, 90 so that they extend the entire length of the thoracic sheath 20. Additional fastening-/releasing means may be added in the area of the shoulders, to yield a vest which opens flat for easy positioning on a patient unable to lift her arms without difficulty. Pockets are optional and may be constructed for access from the top, sides or bottom. Furthermore, the thoracic sheath 20 need not extend to a ventral sheath 30, but may have a backless construction. In addition, the thoracic sheath may extend well below the waist, to enhance fit and support for larger figures, and may continue to extend over the pelvis and legs in the style of a chemise or, alternatively, as a nontubular sheet for protection and/or warmth without restricting the body. The surgical vest 10 may be constructed of one, two, three or more layers of fabric or sheet material.

Preferably, the ventral sheath 30 and the thoracic sheath 20 are joined together to form a seamless tubular sheath, without breach. This seamless construction enhances the comfort of the wearer and prevents decubitus ulceration. Even more preferably, the ventral sheath 30 is less extensile than the thoracic sheath 20, to limit stretch in the area of the back and to enhance support and proper fit in the dorsal area. Ideally, these two fabrics are knit together at their juncture, without seam, but a smooth, nonirritating seam (for example, a seam having external selvages) is an acceptable alternative to the seamless construction.

An unlimited variety of fabrics are suitable for use in the manufacture of the surgical vest 10, including all varieties of natural and synthetic fabrics, nonwoven textiles, laminates, films and thin foams. Preferably, however, the sheet material used in the construction of the surgical vest 10 will be breathable and moisture vapor permeable. The fabric of the preferred embodiment is a stretch knit cotton or cotton blend. Disposable sheet materials, such as sheets or thin foams of polypropylene, hydrophilic polyurethane, and the like, are also suitable for use in the preparation of disposable surgical vests. Preferably, the fabric of the thoracic sheath 20 will be in some way extensile, i.e., will demonstrate at least a minimum of stretchiness with subsequent substantial recovery. An extensile fabric contributes toward the comfortable support of the breasts or prostheses and also holds dressings in place with precision.

The first and second support straps 100, 110 may be made of any fabric or sheet material, having either natural or synthetic constituents. Preferably, however, the first and second support straps 100, 110 will be constructed of non-roll material such as non-roll twill tape, non-roll elastic, grosgrain ribbon, and the like. Elastomeric and nonelastomeric materials may be combined throughout the length of the support strap, or the entire strap may be fashioned of a single material. Preferably, the support strap will include at least a portion of an elastomeric material, and more preferably, will have at least a portion of non-roll elastic along its length.

Because of the construction of the surgical vest 10, a continuous layer of fabric is placed adjacent the entire thorax, covering the postoperative site of a mastectomy or mammoplasty patient. Sterile surgical vests of appropriate materials may be applied to the wound site or surgically packed areas immediately after surgery, or may serve as a support for absorbent materials or other dressings. For example, the surgical vest 10 may anchor a conventional surgical dressing placed beneath it and adjacent to the skin, or may serve to support absorbent materials between its two layers. More particularly, absorbent materials or dressings may be placed in the left and right thoracic pockets 40, 50 in order to hold these materials in the area of the wound and eliminate the necessity for adhesive applications, etc. These thoracic pockets 40, 50 are optional, however, inasmuch as a single-layered garment can position dressings in the area of the wound. If the precise application of particularly shaped dressings is required, such dressings may be provided with an adhesive and the adhesive applied directly to the vest; the surgical vest then maintains the position of the particular dressing in the exact locus required. These special dressings may take any shape and may have any size, and may be inserted in the left and right thoracic pockets or may be attached directly to the inside of the thoracic sheath 20.

Although not usually necessary for the mastectomy or mammoplasty patient, pockets similar to the left and right axillary pockets may be fashioned within the ventral sheath 30. These ventral pockets are optional. In the event of skin grafts, concomitant surgery, or other procedures, the invention then serves not only as a thoracic but also as a ventral dressing and covering.

Some women, including hospital patients, have become accustomed to the compression of a brassierre, particularly across the back. For the comfort of these women, an additional external strap may extend across the ventral sheath with an optional fastening means in the middle. This additional strap gives the sensation of a ventral bra strap without the disadvantages associated with conventional straps. The strap is attached, at either end, in the area under the arm and, because the strap is external to the ventral sheath 30, the strap is nonirritating to the underlying skin and tissues.

The surgical vest may be manufactured in a wide variety of colors and styles. Because the surgical vest has the appearance of a garment suitable for sleep- and leisure-wear, coordinated garments such as bed jackets, shawls, scarves, matching panties, etc., are well suited accompaniments for the present invention. For this reason, although sterile white fabric or disposable surgical vests are well suited for immediate wear after surgery, colorful or otherwise adapted garments having the same physical construction are equally well suited for later postoperative wear and can replace brassierres and corset-like garments entirely.

Comfort can be pretty. Findings or bindings of lace, eyelet, appliques or bows, etc., may be added to the exterior of the garment to give the wearer a feeling of well-being and femininity. Without doubt, the psychologic benefits of an attractive feminine support garment are profound in the postoperative mastectomy or mammoplasty patient.

These garments are especially well-suited, in addition, for use by those experiencing breast pain unrelated to surgery, such as the discomfort associated with premenstrual edema and the pain of fibrocystic disease.

Many modifications and variations of the present invention are possible in light of the above teachings. It is therefore to be understood that within the scope of the appended claims, the invention may be practiced otherwise than as specifically described.

I claim:

1. An article of apparel, comprising:

a thoracic sheath having at least one external strap means thereon which extends, when in position on a wearer; generally from the area of the sternum to a point generally under the arm, and which is attached at each of its ends to said thoracic sheath both in the area of the sternum and at a point generally under the arm, whereby said external strap means positions below and supports the natural or prosthetic breast of the wearer.

2. The article of apparel as in claim 1, wherein said thoracic sheath has two of said external strap means thereon.

3. The article of apparel as in claim 2, wherein said external strap means are elastomeric.

4. The article of apparel as in claim 2, wherein said external strap means are nonelastomeric.

5. The article of apparel as in claim 2, wherein said external strap means include both elastomeric and nonelastomeric segments therein.

6. The article of apparel as in claim 2, wherein said thoracic sheath has at least one pocket therein.

7. The article of apparel as in claim 1, wherein said thoracic sheath is adjacent a ventral sheath.

8. The article of apparel as in claim 7, wherein said thoracic sheath adjoins said ventral sheath in a seamless juncture.

9. The article of apparel as in claim 1, wherein said thoracic sheath is front-opening.

10. The article of apparel as in claim 9, wherein said front-opening thoracic sheath has at least one fastening means thereon.

* * * * *